United States Patent [19]

Hallqvist

[11] 3,973,392

[45] Aug. 10, 1976

[54] PRESSURE PROPELLANT GENERATING SYSTEM

[75] Inventor: Ernst Bernhard Hallqvist, Motala, Sweden

[73] Assignee: Forenade Fabriksverken, Eskilstuna, Sweden

[22] Filed: Oct. 9, 1974

[21] Appl. No.: 513,385

[30] Foreign Application Priority Data

Oct. 10, 1973 Sweden ..... 7313788

[52] U.S. Cl. ..... 60/39.48; 60/39.52; 60/39.55; 114/16 G; 115/34 A

[51] Int. Cl.[2] ..... F02C 3/00; F02C 7/14; B63G 8/12

[58] Field of Search ..... 60/39.05, 39.55, 39.48, 60/39.52; 114/16 G; 115/34 A

[56] References Cited

UNITED STATES PATENTS

| | | | |
|---|---|---|---|
| 1,008,871 | 11/1911 | Sodeau | 60/39.48 |
| 2,711,630 | 6/1955 | Lehman | 60/39.48 X |
| 2,744,380 | 5/1956 | McMillan et al. | 60/39.48 X |
| 2,915,030 | 12/1959 | Perrier | 60/39.48 X |
| 2,974,619 | 3/1961 | Bombl et al. | 60/39.48 X |
| 3,099,133 | 7/1963 | Singelmann | 60/39.48 X |
| 3,101,592 | 8/1963 | Robertson et al. | 60/39.05 X |
| 3,134,353 | 5/1964 | Pedersen et al. | 60/39.48 X |
| 3,180,089 | 4/1965 | Dodge | 60/39.48 |
| 3,229,462 | 1/1966 | Fatica | 60/39.55 X |
| 3,328,957 | 7/1967 | Rose | 60/39.05 X |

*Primary Examiner*—Carlton R. Croyle
*Assistant Examiner*—Robert E. Garrett
*Attorney, Agent, or Firm*—Fleit & Jacobson

[57] ABSTRACT

A pressure propellant generating system for a power plant in a submarine vehicle, said propellant including a sea water component, the pressure of which can be regulated so as to vary the output of the power plant in a controlled manner.

4 Claims, 1 Drawing Figure

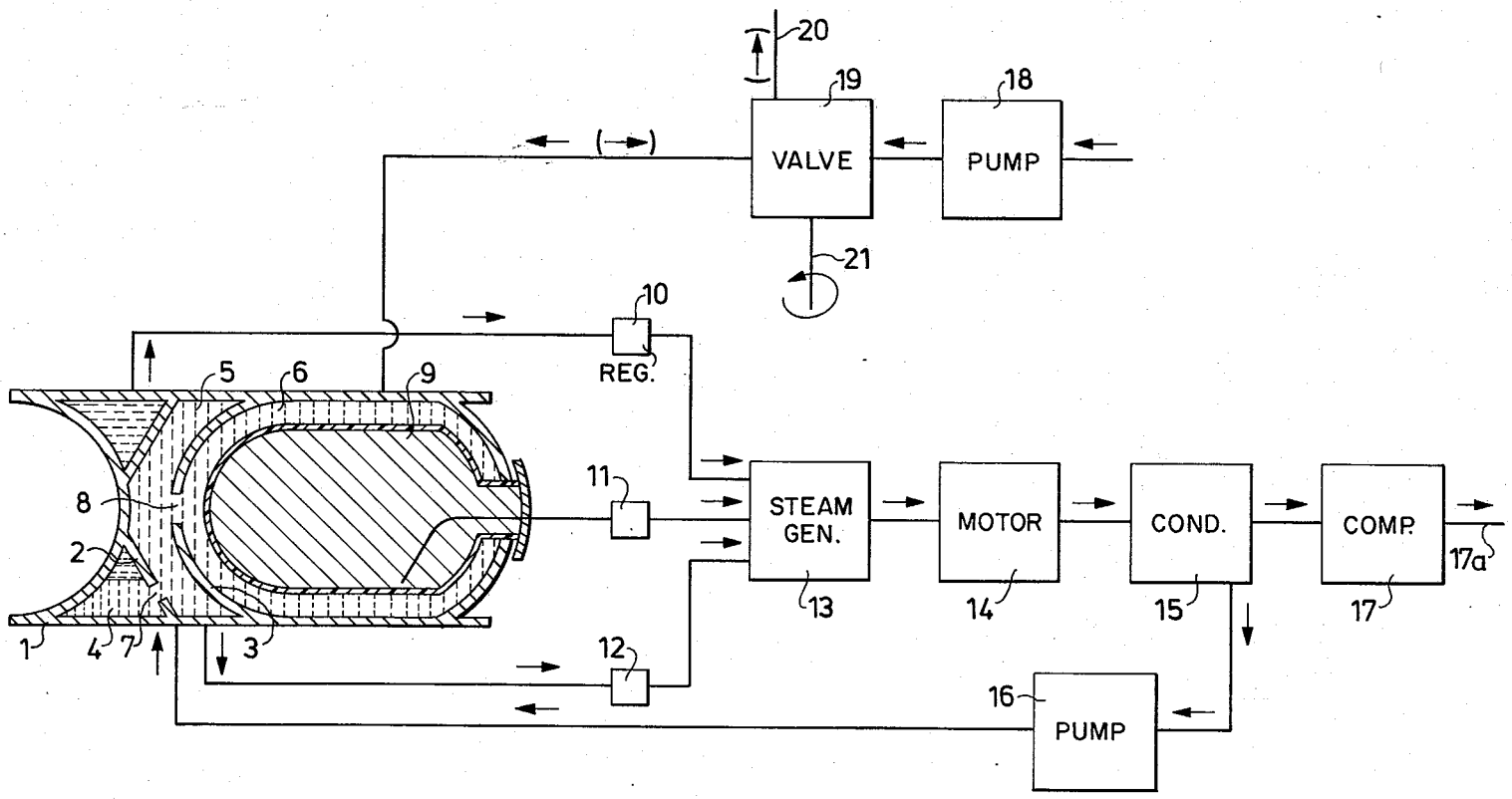
COMP.
17a
17
COND.
15
PUMP
16
MOTOR
14
STEAM GEN.
13
PUMP
18
VALVE
19
20
21
REG.
10
11
12
9
6
5
3
8
2
7
4
1

PRESSURE PROPELLANT GENERATING SYSTEM

The present invention relates to a system for generating and delivering a propellant under pressure to a power plant of an underwater vehicle, for example a torpedo of the type having a plurality of receptacles for various components of the propellant.

In steam torpedoes the delivery of the propellant is normally effected under pressure. The receptacles are then pressurized to a pressure greater than the pressure that is required in the steam generator (the so called admission pressure). The flow of propellant and also the efficiency of the power plant and the speed of the torpedo is dependent on the pressure difference between the receptacles and the steam generator, and can also be controlled by pre-set pressure adjusting means located in the conduits to the steam generator. In operation, the volume of propellant stored in the receptacles is gradually reduced and replaced by compressed air. This results in the following disadvantages: fast changes of the speed of the torpedo cannot be practically effected by changing the pressure of the tanks; compressed air as well as a cooling medium has to be conveyed by the torpedo; the weight and also the position of the centre of gravity of the torpedo is affected in the firing cycle of the torpedo; the depth of submersion of the torpedo strongly affects the efficiency of the power plant and also the speed of the torpedo.

It has also been proposed to pressurize the receptacles of the torpedo with sea water. However, said sea water has then not taken any part in the process of steam generation, and hence the sea water cannot be used to control the output of the power plant. In other known systems there has been proposed to use sea water as a cooling medium, which, however, has caused problems because of the salt content of the sea water.

The object of the present invention is therefore to provide a system for generating a pressure propellant in a manner which overcomes the disadvantages found in the prior art techniques.

Further objects and advantages of the present invention will become apparent from the following detailed description of the invention taken with the accompanying drawing, which is a schematic diagram thereof as embodied in a submarine torpedo.

Referring to the drawing, numeral 1 designates the hull of a torpedo tank, having two intermediate walls 2 and 3 defining three compartments 4, 5 and 6, respectively. The compartment 4 communicates with compartment 5 through an opening 7 formed in the wall 2 in the vicinity of the hull 1. The compartments 5 and 6 communicate with one another through an opening 8 formed in the centre of the wall 3.

The compartment 4 contains a suitable fuel, indicated in the drawing by horizontal dashed lines, whereas the compartments 5 and 6 contain cooling water, indicated in the drawing by vertical dashed lines. This embodiment therefore implies the use of a fuel which is not water soluble and which has a lower density than water. A collapsible bag 9 which contains a suitable oxidant is contained within the compartment 6. The sea water entering the compartment 4 supplies a pressure on the fuel to expel it from the compartment. Similarly, the sea water present in compartment 6 supplies a pressure exteriorly of the bag 9 to expel oxidant therefrom.

The three different propellant components fuel, oxidant and cooling water are thus delivered under pressure through pre-set adjusting means 10, 11 and 12, respectively, to a steam generator 13, in which propellant gas for a motor 14 is generated. Exhaust gas from the motor 14 is delivered to a condensor 15 in which water steam is condensed. A pump 16, for example a gear pump, brings back the condensate to the compartment 5. The non-condensible portion of the exhaust gas is compressed by a compressor 17 to a pressure above the external water pressure. In this way, the back pressure of the motor is maintained at a substantially constant value regardless of the torpedo depth. Draining is effected through an outlet 17*a*, Since the volume of condensate is less than that of used propellant, the compartment 5 is supplied with a further quantity of water from the sea through a pump 18, for example a gear pump. This water flows through a pressure regulating valve 19 which is provided with a draining outlet 20 and with a regulator 21 for adjusting the pressure. The function of the valve 19 and regulator 21 may be obtained instead by a gear pump having a variable number of revolutions and having a changeable direction of rotation.

The total capacity of the pumps 16 and 18 is chosen to exceed the use of propellant at constant motor output. Therefore, some of the water pumped into the tank 1 is drained through the draining outlet 20. The quantity of drained sea water and the pressure present in the compartments 4–6 is responsive to the adjustment of the pressure adjusting valve 19. More specifically, when reducing the motor output by adjusting the valve 19 by means of the regulator 21, water is drained from the compartments 4–6 through the outlet 20 until the pressure of the compartments has fallen to a value adjusted on regulator 21, whereupon the valve 19 maintains the pressure constant at said value. When increasing the motor output, the valve 19 closes the outlet 20 until the adjusted higher pressure value has been reached.

The aforedescribed system allows fast changes of the motor output by only changing the adjustment of the pressure regulating valve 19. When changing the motor output, the relative quantities of oxidant, fuel and cooling medium are maintained at a constant value, and hence also the admission temperature is maintained constant. In addition, the need of compressed air for delivering the propellants is eliminated. Furthermore, any changes of weight and centre of gravity is minimized. Because of the return delivery of condensate the quantity of cooling water conveyed by the torpedo can be considerably reduced. Besides, the steam generator 13 is supplied with water from the compartment 6 which is supplied via compartment 5 with condensate from the condenser 15. In this way, the steam generator 13 is supplied with water substantially consisting of condensate, thereby to cause the water returning to the process to be free from salt. Any influence of the torpedo depth on power efficiency and torpedo speed is also minimized because the back pressure of the motor is maintained at a substantially constant value.

It is to be noted that the described system enables the use of one or more propellant components together with the cooling water component. The compartments containing said propellant components may be rigid or collapsible depending on the characteristics of the propellant components being used.

While a preferred embodiment of the present invention has been illustrated and described, it is to be understood that the invention is not limited thereby, but is susceptible to changes and modifications within the scope of the appended claims.

I claim:

1. A pressure propellant generating system for a power plant in an underwater vehicle comprising, in combination, a propulsion motor, a steam generator for supplying a propellant to said motor, a first compartment containing a first propellant component, means for conducting said first propellant component to said steam generator, a second compartment communicating with said first compartment, first pump means for supplying pressurized water from the sea to said first compartment to expel said first propellant component from said first compartment to said steam generator through said conducting means, means for condensing the waste propellant gases discharged from said motor to form a condensate, second pump means for conducting said condensate under pressure to said second compartment to supplement the expulsion of said first propellant component from said first compartment by said pressurized sea water, means for conducting a quantity of said condensate from said second compartment to said steam generator, a third compartment containing a second propellant component, and means for delivering said second propellant component from said third component to said steam generator.

2. A system as defined in claim 1 including compressing means for compressing a non-condensable component of said waste propellant gases discharged from said motor.

3. A system as defined in claim 1 wherein, said third compartment is communicating with said second compartment whereby the pressure of said condensate in said second compartment produces an explusion of said second propellant component from said third compartment to said steam generator through said delivering means.

4. A system as defined in claim 1 including a collapsible bag in said first compartment for containing said first propellant component and wherein said pressurized sea water is supplied to said first compartment exteriorly of said bag.

* * * * *